United States Patent [19]

Watanabe

[11] Patent Number: 4,840,508

[45] Date of Patent: Jun. 20, 1989

[54] MECHANICAL PENCIL CAPABLE OF AUTOMATICALLY PROPELLING SUCCESSIVE LENGTHS OF LEAD

[75] Inventor: Hiroyuki Watanabe, Hiratsuka, Japan

[73] Assignee: Pilot Precision Kabushiki Kaisha, Kanagawa, Japan

[21] Appl. No.: 87,863

[22] Filed: Aug. 21, 1987

[30] Foreign Application Priority Data

| | | | |
|---|---|---|---|
| Jan. 29, 1987 | [JP] | Japan | 62-17363 |
| Feb. 23, 1987 | [JP] | Japan | 62-25196[U] |
| Mar. 4, 1987 | [JP] | Japan | 62-31557[U] |

[51] Int. Cl.[4] ..... B43K 21/22

[52] U.S. Cl. ..... 401/65; 401/67; 401/81; 401/94

[58] Field of Search ..... 401/53, 65, 67, 80, 401/81, 85, 86, 94, 92, 93

[56] References Cited

U.S. PATENT DOCUMENTS

| | | | |
|---|---|---|---|
| 4,478,529 | 10/1984 | Morio | 401/94 X |
| 4,504,163 | 3/1985 | Hashimoto et al. | 401/81 X |
| 4,521,126 | 6/1985 | Sakaoka et al. | 401/81 X |
| 4,538,934 | 9/1985 | Brunner . | |
| 4,650,359 | 3/1987 | Sakaoka | 401/94 X |

FOREIGN PATENT DOCUMENTS

| | | | |
|---|---|---|---|
| 0231893 | 8/1987 | European Pat. Off. | 401/65 |
| 3317381 | 2/1985 | Fed. Rep. of Germany | 401/53 |
| 59-118580 | 8/1984 | Japan . | |
| 60-166161 | 10/1985 | Japan . | |

*Primary Examiner*—Richard J. Apley
*Assistant Examiner*—Franklin L. Gubernick
*Attorney, Agent, or Firm*—Wenderoth, Lind & Ponack

[57] ABSTRACT

A mechanical pencil has a body with a lead storage chamber defined therein for housing spare lengths of lead, and a tubular lead guide receiving a length of lead and coaxially mounted in the body so as to partly protrude outwardly from its writing end. During writing or marking, the lead guide gradually retracts into the body against the force of a return spring with the wear of the lead received therein and, when the pencil is moved off the writing surface, it is held in place by a locking mechanism until a preselected wear point is reached, then it is sprung back to its normal position. Disposed intermediate the lead storage chamber and the lead guide, a chuck coacts with an internally tapered socket for gripping the lead against displacement away from the writing end of the body. A chuck opener member is coupled to the lead guide in order to hold the chuck open when the lead guide is in the normal position, in order to assure the uninterrupted delivery of the successive lengths of lead from the lead storage chamber into the lead guide.

6 Claims, 13 Drawing Sheets

MECHANICAL PENCIL CAPABLE OF AUTOMATICALLY PROPELLING SUCCESSIVE LENGTHS OF LEAD

BACKGROUND OF THE INVENTION

This invention relates to writing or marking implements in general and, in particular, to a mechanical pencil featuring provisions for propelling successive lengths of lead without manual assistance, with a view to uninterrupted writing or marking during a change from one length of lead to another.

Mechanical pencils have been suggested in which the lead, whenever worn to a prescribed degree, is automatically propelled by the same degree. There have also been proposed those which are constructed not only for the automatic lead propelling capability but also for automatically supplying successive lengths of lead, such that when one length of lead is used up, another length of lead automatically follows for uninterrupted writing. Japanese Laid Open Utility Model Application No. 59-118580 represents an example of the second recited type of mechanical pencil.

The prior art device according to the noted Japanese utility model application comprises a lead guide movable back and forth with the lead within the pencil body, and a chuck gripping the lead against retraction (i.e. movement in a direction away from the writing end of the pencil body). Also provided are magnetic means acting between the lead guide and the chuck for opening the latter during the forward or downward travel (i.e. movement toward the writing end) of the lead guide. The next length of lead is to fall under its own weight into and through the chuck when the latter is open, and is to be gripped by the chuck when the lead guide completes its forward stroke.

Thus, according to this prior art device, the new lead has had to fall through the chuck during the very brief interval of time when it is open. There has been no guarantee that the new lead will do so, as its gravity falling through the chuck depends upon the pencil attitude at that moment.

SUMMARY OF THE INVENTION

The present invention aims at the provision of an improved mechanical pencil that overcomes the above discussed weakness of the prior art by assuring the continuous propelling of successive lengths of lead for uninterrupted writing.

Stated in brief, the improved mechanical pencil of this invention comprises substantially tubular body means having a lead storage chamber defined therein for accommodating spare lengths of lead. A tubular lead guide for receiving a length of lead for writing or marking is coaxially received in the body means so as to partly protrude from the writing end thereof, the lead guide having a preassigned normal position with respect to the body means and being retractable relative to the body means from the preassigned normal position in a direction away from the writing end thereof against the bias of a return spring with the wear of the lead. A friction member is mounted to the lead guide for engaging the lead so as to normally cause the lead to travel with the lead guide in the axial direction of the body means. Also mounted within the body means are chuck means comprising a socket which is fixedly mounted within the body means and which has an internal annular tapered surface, with the tapered surface being concentric with the body means and decreasing in diameter as it extends away from the writing end of the body means. The chuck means further comprise a chuck mounted within the socket and coacting therewith for releasably gripping the lead, the chuck being displaceable axially of the body means relative to the socket between an open position, closer to the writing end of the body means, for permitting the free passage of the lead therethrough, and a closed position, away from the writing end of the body means, for tightly gripping the lead. A chuck spring biases the chuck from the open toward the closed position. The mechanical pencil further comprises chuck opening means coupled to the lead guide for joint displacement therewith axially of the body means. Upon displacement of the lead guide from a retracted to the normal position under the bias of the return spring, the chuck opening means actuates the chuck from the closed to the open position against the bias of the chuck spring.

It will have been noted from the foregoing summary of the invention that the chuck is held open as long as the lead guide stays in the preassigned normal position, instead of opening only for a brief time during the return of the lead guide toward the normal position as in the above referenced prior art. Therefore, when one length of lead is used up, the next length of lead can be unfailingly delivered through the open chuck into the lead guide.

The above and other features and advantages of this invention and the manner of realizing them will become more apparent, and the invention itself will best be understood, from a study of the following description and appended claims, with reference had to the attached drawings showing some preferable embodiments of the invention.

DETAILED DESCRIPTION

Figure 1A:
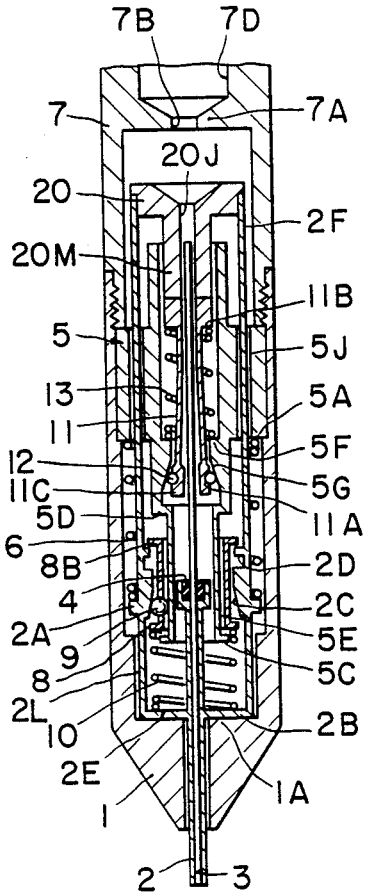
FIG. 1*a* is a fragmentary axial section through a front part, including the writing end of the body means, of the mechanical pencil incorporating the novel concepts of the invention, with the tubular lead guide shown in the preassigned normal position and with the chuck shown open.
Figure 1B:
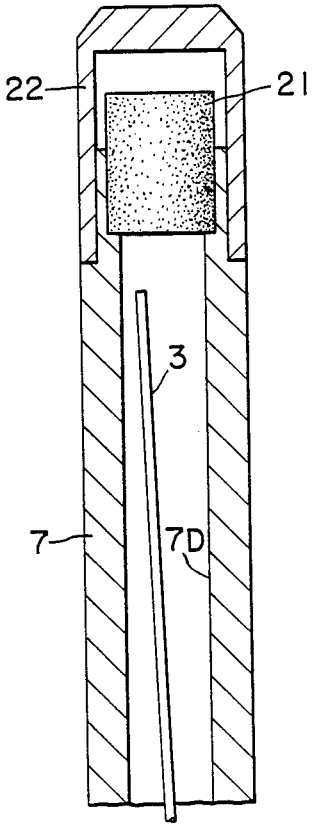
FIG. 1*b* is a fragmentary axial section through the remainder of the mechanical pencil of FIG. 1*a;*

Reference is first directed to FIGS. 1*a* and 1*b* for a consideration of the construction of one preferable embodiment of the invention. The mechanical pencil seen in these illustrations has a substantially tubular body 1 having a writing or marking end shown directed down in FIG. 1*a*. A tubular lead guide 2, capable of guiding a lead 3 axially therethrough, is concentrically mounted within the body 1 for axial displacement relative to the same and partly extends outwardly or forwardly from the writing end of the body. The lead guide 2 carries on its rear end, disposed within the body 1 and shown directed up in FIG. 1*a*, a friction shoe 4 of rubber or like elastic material for frictionally embracing the lead 3 as the latter extends into the lead guide.

Coaxially and immovably mounted within the rear part, away from the writing end, of the body 1 is a substantially tubular socket 5 constituting a part of chuck means to be detailed presently. The socket 5 is configured to provide a forwardly facing shoulder 5A. In axially opposed relation to this socket shoulder 5A, a collar 2A is formed on a sleeve 2L which is intergrally and coaxially joined to the lead guide 2 via a shoulder 2B. A helical compression spring 6 (hereinafter referred to as the return spring) extends between socket shoulder 5A and collar 2A thereby biasing the lead guide 2 toward its preassigned normal position as depicted in FIG. 1*a*, in which the lead guide shoulder 2B butts on the step 1A of the body 1, with the lead guide fully extending outwardly from the writing end of the body.

This mechanical pencil includes a one-way locking mechanism which permits the lead guide 2 to retract into the body 1 against the force of the return spring 6 with the wear of the lead 3 but which locks the lead guide against return travel to its normal position until each length of lead 3 wears to a prescribed degree. The one-way locking mechanism includes an annular internal taper or tapered surface 2C which is formed concentrically on the sleeve 2L and which decreases in diameter as it extends away from the writing end of the body 1. An annular ridge 2D is also formed on the inside surface of the sleeve 2L and is disposed farther away from the writing end of the body 1 than is the taper surface 2C.

Another constituent part of the one-way locking mechanism is a tubular forward extension 5E of the socket 5 which is concentrically nested in the sleeve 2L and which terminates in a flange 5C. A ball cage 8 in the form of a tube with a pair of flanges at both ends is concentrically interposed between sleeve 2L and socket extension 5E for axial displacement between the flange 5C of the socket extension 5E and a shoulder 5D of the socket 5. The ball cage 8 has a plurality (e.g. three) of holes defined therein at constant circumferential spacings each for rotatably receiving a ball 9. Normally, all these balls 9 are wedged in between the taper surface 2C of the sleeve 2L and the socket extension 5E under the pressure of a compression spring 10 acting between the surface 2E of the lead guide shoulder 2B and the flanged front end of the ball cage 8. The compression spring 10 will be hereinafter referred to as the locking spring.

Figure 2:
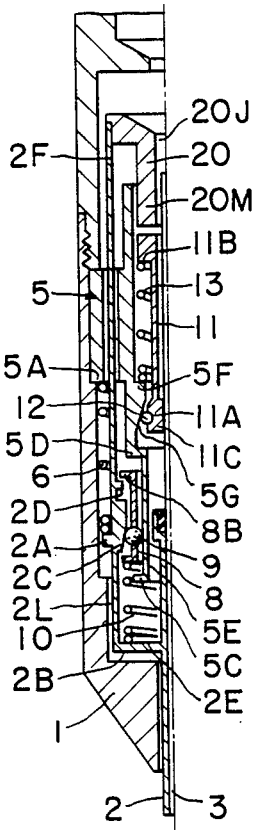
FIG. 2 is a view similar to FIG. 1*a* except that the lead guide is shown slightly retracted into the body to close the chuck.
Figure 3:
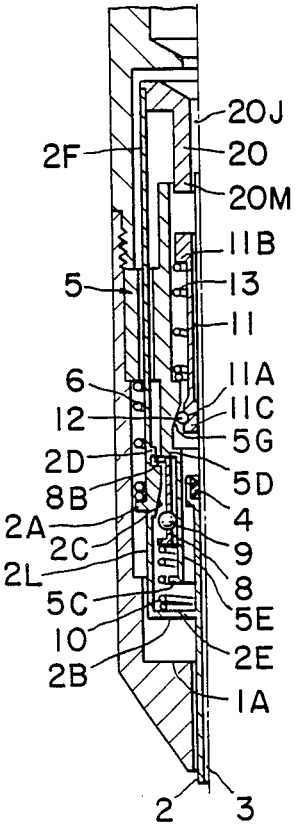
FIG. 3 is also a view similar to FIG. 1*a* except that the lead guide is shown fully retracted into the body before being sprung back to the normal position.

As will be seen also in FIGS. 2 and 3, the flange 8B on the rear end of the ball cage 8 is capable of resiliently riding back and forth over the inside ridge 2D of the sleeve 2L and is further capable of engagement therewith, as in FIG. 3, when each length of lead 3 is worn to the prescribed degree. So engaged with the sleeve ridge 2D, the ball cage flange 8B will remain engaged therewith in the face of the the rearward force of the locking spring 10 acting on the ball cage 8 but will disengage the sleeve ridge under the forward force of the return spring 6 acting on the sleeve 2L. As required, the ball cage 8 may be provided with several parallel slits extending forwardly from its rear end, in order to add elasticity to its rear end portion.

At 20 in FIG. 1*a* is seen a thrust member constituting a feature of the invention. Generally in the shape of a short cylinder or disk, the thrust member 20 has a cylindrical portion 20M of reduced diameter loosely extending into the socket 5. A lead passageway 20J is defined axially through the thrust member 20. The thrust member 20 is coupled to the sleeve 2L, and thence to the lead guide 2, via connective strips 2F extending rearwardly from the sleeve through clearance holes 5J in the socket 5.

Next to be referred to is the chuck means comprising the socket 5. This socket has an annular internal taper surface 5G, concentric with the body 1, which decreases in diameter as it extends away from the writing end of the body. Another component of the chuck means is a chuck 11 in the form of a tube coaxially disposed within the socket 5 for axial displacement relative to the same and loosely surrounding the lead 3 as it extends from the thrust member 20 to the lead guide 2. The front end of the chuck 11 is enlarged and split longitudinally to provide a set of gripping jaws 11C for frictionally gripping the lead 3. The gripping jaws 11C are self-biased radially outwardly. A series of concavities or like depressions 11A in the outer surfaces of the gripping jaws 11C rotatably receive balls 12 which are urged by the gripping jaws against the internal taper 5G of the socket 5. An additional helical compression spring 13, hereinafter referred to as the chuck spring, acts between a flange 11B on the rear end of the chuck 11 and an internal annular shoulder 5F of the socket 5, biasing the chuck away from the writing end of the body 1. The force of the chuck spring 13 is less than that of the return spring 6 urging the lead guide 2 forwardly of the body 1.

The noted thrust member 20, rigidly coupled to the lead guide 2, is movable into and out of end-to-end abutment against the chuck 11 with the axial displacement of the lead guide relative to the body 1. When the lead guide 2 is in the predetermined normal position as shown in FIG. 1*a*, the thrust member 20 thrusts the chuck 11 forwardly of the socket 5 against the force of the chuck spring 11. So thrusted forwardly, the gripping jaws 11C of the chuck 11 will spread apart under their own bias as the balls 12 roll forwardly over the socket taper 5G.

As will be seen from both FIGS. 1*a* and 1*b*, a sheath 7 is screwed into the body 1 so as to form a rearward or upward extension thereof. The sheath 7 defines a lead storage chamber 7D accommodating a suitable number of spare leads 3, only one being shown in FIG. 1*b*. A partition 7A formed in one piece with the sheath 7 provides a funnel-shaped bottom of the lead storage chamber 7D, with a hole 7B defined axially therethrough for the delivery of only one lead at one time into the passageway 20J in the thrust member 20. The sheath 7 has its rear end closed by an eraser 21, which in turn is enveloped by a cap 22 removably fitted over the rear end of the sheath.

In operation, FIG. 1 depicts the normal state of the mechanical pencil when it is not in use, with the lead guide 2 fully extending from the writing end of the body 1 under the force of the return spring 6, and with the gripping jaws 11C of the chuck 11 held open by the thrust member 20 against the force of the chuck spring 13. The pencil is to be put to use with the tip of the lead 3 disposed substantially flush with the tip of the lead guide 2. Not only the lead tip but also the lead guide tip is to be held against a desired surface for writing or marking.

When the tips of the lead guide 2 and lead 3 are initially pressed against the writing surface, both the lead guide and lead will slightly retract into the body 1 against the bias of the return spring 6, the lead 3 being engaged by the friction shoe 4 on the rear end of the lead guide 2. Being coupled fast to the lead guide 2, the thrust member 20 will also retract out of abutting contact with the chuck 11, whereupon the latter will also retract under the bias of the chuck spring 13, with the consequent gripping of the lead 3 by the gripping jaws 11C.

FIG. 2 represents this state. By virtue of the wedging action of the gripping jaws 11C caught in the internal taper 5G of the socket 5 via the balls 12 under the bias of the chuck spring 13, the chuck 11 firmly locks the lead against further retraction into the body 1 but permits the lead to travel forwardly upon exertion of a relatively small force thereon. If the pencil is put to use in this state, the lead guide 2 as well as the sleeve 2L and thrust member 20 will gradually retract further into the body 1 with the wear of the lead 3. Both ball cage 8 and balls 9 of the one-way locking mechanism will also retract with the lead guide 3 since these balls do not stick between socket extension 5E and taper surface 2C during such retraction of the lead guide 3.

The one-way locking mechanism performs the function of preventing the lead guide 2 from being sprung back to the FIG. 1*a* position when the pencil is moved off the writing surface before the lead 3 is worn to a predetermined degree. This is because the balls 9 of the one-way locking mechanism become wedged in between taper surface 2C and socket extension 5E against the forward displacement of the lead guide 2 and lead 3 under the force of the return spring 6. As the lead guide 2 is thus locked against forward displacement, so is the thrust member 20 which is firmly joined to the lead guide. Consequently, the lead 3 will remain firmly engaged by the chuck 11 against retraction.

As illustrated in FIG. 3, the ball cage 8 will come to butt on the shoulder 5D of the socket 5 when the lead 3 is worn to the prescribed degree. Thereupon the ball cage flange 8B will ride forwardly over the ridge 2D on the sleeve 2L, resulting in the disengagement of the balls 9 from between taper surface 2C and socket extension 5E. If now the pencil is moved off the writing surface, the balls 9 will remain disengaged from between taper surface 2C and socket extension 5E because the ball cage flange 8*b* remains engaged with the front side of the ridge 2D against the force of the locking spring 10. Accordingly, the lead guide 2 as well as the thrust member 20 will travel forwardly of the body 1 under the bias of the return spring 6. The lead 3, being frictionally engaged by the shoe 4 on the rear end of the lead guide 2, will also travel with the lead guide without being impeded by the wedging action of the balls 12.

Sprung forwardly with the lead guide 2, the thrust member 20 will come into abutment against the chuck 11 and thrust the same forwardly against the force of the chuck spring 13. The gripping jaws 11C will then spread apart under their own bias to permit the free passage of the lead 3. With some more forward travel of the lead guide 2 with the thrust member 20, the ridge 2D on the sleeve 2L will force the ball cage 8 into abutment against the flange 5C on the front end of the socket extension 5E whereupon the ball cage flange 8B will ride back over the ridge 2D. Finally, as illustrated in FIG. 1*a*, the forward travel of the lead guide 3 will come to an end as its shoulder 2B comes to butt on the inside shoulder 1A of the body 1. The balls 9 will become re-engaged between taper surface 2C and socket extension 5E as the locking spring 10 urges the ball cage 8 rearwardly with respect to lead guide 3 and socket 5.

When the lead 3 is used up by the repetition of the foregoing cycle, a new length of lead must be delivered from the supply chamber 7D into the lead guide 2. It is toward this end that the chuck 11 is held open when the lead guide 2 is in the normal position of FIG. 1*a*. Actually, by the time one length of lead is used up, the next length will have fallen by gravity into the lead guide 2 through the passageway 20J in the thrust member 20 and the open chuck 11 while the pencil is being held upstandingly.

EMBODIMENT OF FIG. 4

Figure 4:
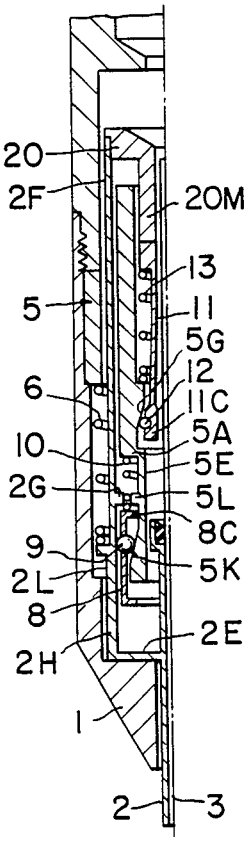
FIG. 4 is a fragmentary axial section through another preferred form of mechanical pencil in accordance with the invention.

The mechanical pencil of FIG. 4 is equivalent to the proceeding embodiment in having the thrust member 20 coupled to the lead guide 2. This second embodiment imcorporates a slightly modified one-way locking mechanism. The socket extension 5E is externally tapered at 5K on its front end portion, with the taper surface decreasing in diameter as it extends rearwardly of the socket extension. The socket extension 5E also has an annular ridge 5L formed on its outer surface and spaced rearwardly from the taper surface 5K.

Interposed between sleeve 2L and socket extension 5E for rotatably carrying the balls 9 as in the preceding embodiment, the ball cage 8 has an inturned rim 8C on its rear end so as to ride back and forth over the ridge 5L on the socket extension 5E. The ball cage rim 8C normally lies forwardly of the ridge 5L. The rear end of the ball cage 8 is also arranged for movement into and out of abutting engagement with an annular inside rim 2G of the sleeve 2L. The locking spring 10 extends between the ball cage rim 8C and the socket shoulder 5A, biasing the ball cage 8 forwardly. Normally, therefore, the balls 9 are caught between the inside surface 2H of the sleeve 2L and the taper surface 5K of the socket extension 5E under the bias of the locking spring 10. The ball cage rim 8*c* and ridge 5L are capable of locking engagement with each other in opposition to the force of the locking spring 10 but are to disengage when the ball cage is acted upon by the return spring 6 biasing the lead guide 2 forwardly of the body 1.

This FIG. 4 mechanical pencil is analogous in operation with that of FIGS. 1*a*–3, with the gripping jaws 11C held open by the thrust member 20 against the force of the chuck spring 13. During writing, however, the gripping jaws 11C will be held closed under the force of the chuck spring 13. The lead guide 2 will retreat into the body 1 with the wear of the lead 3 without being impeded by the balls 9. It will also be seen that the balls 9 function to prevent the lead guide 2 from being sprung forwardly when the pencil is moved off the writing surface during the progress of lead wear.

When the lead 3 is worn to the predetermined degree, the shoulder 2E of the lead guide 3 will push the ball cage 8 rearwardly until the ball cage rim 8C rides over the ridge 5L on the socket extension 5E. Despite the forward thrust of the locking spring 10, the ball cage rim 8C will remain in engagement with the rear side of the socket extension ridge 5L when the pencil is subsequently moved off the writing surface, thereby holding the balls 9 disengaged from between sleeve 2L and taper surface 5K. The lead guide 2 is now free to travel back to the illustrated normal position with the lead 3 and thrust member 20 under the bias of the return spring 6. During such return travel of the lead guide 2 the inside ridge 2G on the sleeve 2L will engage the rear end of the ball cage 8 for pushing the same back to the illustrated position by overriding the ridge 5L on the socket extension 5E.

Of course, when the lead guide 2 returns to the normal position, the thrust member 20 coupled thereto opens the chuck 11 thereby assuring the delivery of successive lengths of lead into the lead guide 2.

EMBODIMENT OF FIG. 5

Figure 5:
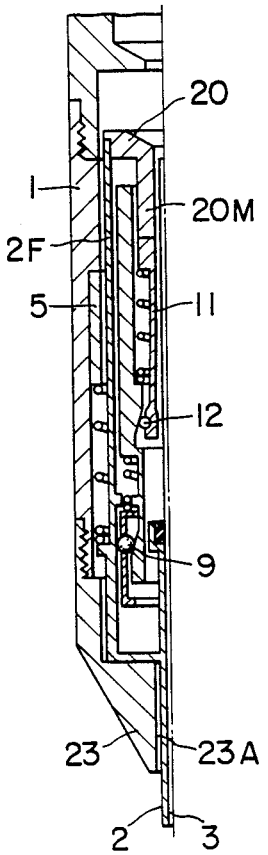
FIG. 5 is a fragmentary axial section through a slight modification of the mechanical pencil of FIG. 4.

FIG. 5 shows a slight modification of the FIG. 4 embodiment. The modification resides in a mouthpiece 23 of conical shape screw-threadedly attached to the front end of the body 1 and defining an axial hole 23A through which the lead guide 2 extends for axial displacement. Being removable from the body 1, the mouthpiece 23 permits the socket 5 and other parts of the pencil to be inserted in the body 2 through its front end. The other details of construction and operation are as previously set forth in connection with the FIG. 4 embodiment.

As will be readily understood, the thrust member 20 used in all the foregoing embodiments need not be coupled to the lead guide 2 via the connective strips 2F integral with the sleeve 2L. All these parts may be formed in one piece, or divided into discrete units, to conform to design preferences or assemblage conveniences without departing from the scope of the invention.

EMBODIMENT OF FIGS. 6 AND 7

Figure 6:
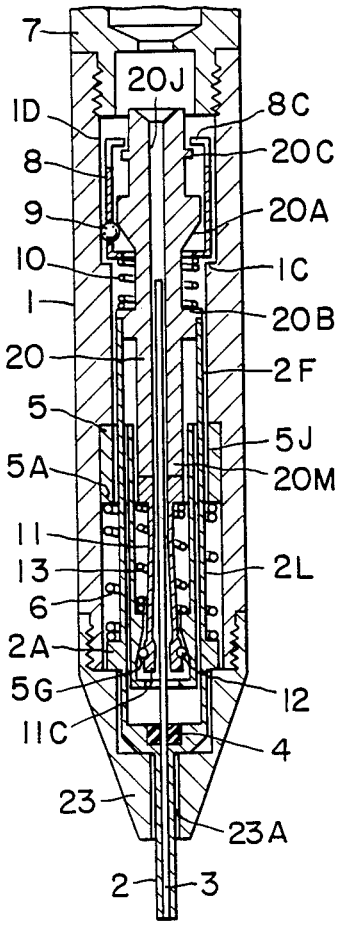
FIG. 6 is a fragmentary axial section through a further preferred form of mechanical pencil in accordance with the invention, with the lead guide shown in the preassigned normal position.
Figure 7:
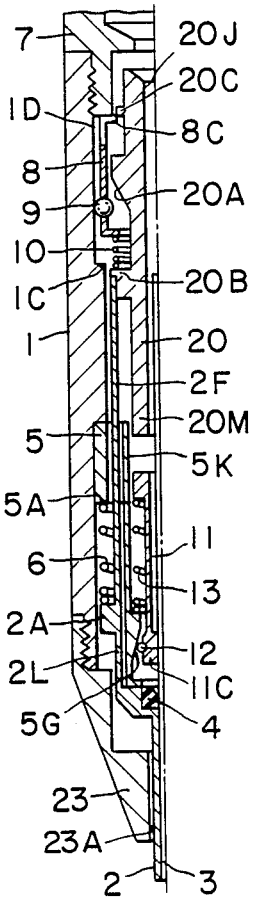
FIG. 7 is a view similar to FIG. 6 except that the lead guide is shown fully retracted into the body.

A further preferred embodiment of the invention shown in FIGS. 6 and 7 also has the mouthpiece 23 screwed to the front end of the body 1, with the lead guide 2 extending through its axial hole 23A. The lead guide 2 is biased forwardly of the body 1 by the return spring 6 disposed between the shoulder 5A of the socket 5 and the collar 2A on the sleeve 2L integral with the lead guide. The socket 5 has the internal taper 5G adjacent its front end. The sleeve 2L has the connective strips 2J extending rearwardly therefrom through clearance holes 5J in the socket 5 and secured to the thrust member 20.

Concentrically disposed within the socket 5 is the chuck 11 coacting with its internal taper 5G to firmly grip the lead 3 against rearward displacement but to permit its forward sliding motion, as in all the foregoing embodiments. When the lead guide 2 is in the normal position of FIG. 6, the thrust member 20 is held endwise against the chuck 11 under the force of the return spring 6, urging the chuck forwardly with respect to the socket 5 against the force of the chuck spring 13 so that the gripping jaws 11C are open under their own bias.

The one-way locking mechanism is provided between body 1 and thrust member 20 in this embodiment. Concentrically interposed between body 1 and thrust member 20, the ball cage 8 rotatably carrying the balls 9 takes the form of a tube having a pair of inturned rims at its opposite ends. The ball cage 8 is capable of axial displacement between the rearwardly facing shoulder 1C of the body 1 and the front end of the sheath 7 screwed into the rear end of the body 1. The locking spring 10 extends between the shoulder 20B of the thrust member 20 and the front end rim of the ball cage 8 for biasing the ball cage rearwardly with a force less than that of the return spring 6. With the ball cage 8 so sprung rearwardly, the balls 9 are normally captured between the inside surface 1D of the body 1 and an external taper 20A formed on the thrust member 20. The taper 20A increases in diameter as it extends rearwardly of the thrust member 20.

The thrust member 20 is further formed to include an annular ridge 20C disposed rearwardly of the taper 20A for engagement with the rear end rim 8C of the ball cage 8. The ball cage 8 has several parallel slits extending forwardly from its rear end in order to impart radially inward self-bias to its rear end rim 8C. This self-bias is such that the ball cage rim 8C can positively engage the thrust member ridge 20C in opposition to the force of the locking spring 10 but will disengage the ridge 20C when the thrust member 20 is forced forwardly by the return spring 6.

As this mechanical pencil is held against a desired writing surface with its various working parts in the state of FIG. 6, the lead 3 will slightly retract against the force of the return spring 6 with the lead guide 2 and thrust member 20. With the slight retraction of the thrust member 20 the chuck 11 will also retract under the bias of the chuck spring 13, with the consequent engagement of its gripping jaws 11C in the socket taper 5G. Now the lead 3 is locked against any further retraction but is relatively free to travel forwardly. The pencil is to be put to writing in this state.

The lead guide 2 and thrust member 20 will gradually retract against the force of the return spring 6 with the wear of the lead 3 as a result of writing. Such members are not to be sprung back by virtue of the wedging action of the balls 9 of the one-way locking mechanism when the pencil is moved off the writing surface.

As the wear of the lead 3 proceeds, the ball cage 8 will come to butt on the front end of the sheath 7. Then, with some more wear of the lead 3, the annular ridge 20C on the thrust member 20 will travel rearwardly past the rear end rim 8C of the ball cage 8, and the balls 9 will be dislodged from between body 1 and thrust member taper 20A against the force of the locking spring 10, as illustrated in FIG. 7. The rear end rim 8C of the ball cage 8 is capable of positive engagement with the thrust member ridge 20C against the force of the locking spring 10. Therefore, when the pencil is subsequently moved off the writing surface, the balls 9 will remain dislodged from between body 1 and thrust member taper 20A thereby permitting the lead guide 2 to be propelled forwardly with the lead 3 under the bias of the return spring 6.

Travelling forwardly with the thrust member 20, the ball cage 8 will then come into abutment against the internal shoulder 1C of the body 1. The ball cage rim 8C will then disengage the thrust member rim 20C and ride rearwardly thereover as the thrust member 20 is further forced forwardly to the FIG. 6 position by the return spring 6. The thrust member 20 will thrust the chuck 11 forwardly against the force of the chuck spring 13 when the lead guide 2 returns to the normal position, thereby opening the gripping jaws 11C and so assuring the continuous delivery of the successive lengths of lead 3 into the lead guide 2.

EMBODIMENT OF FIG. 8

Figure 8:
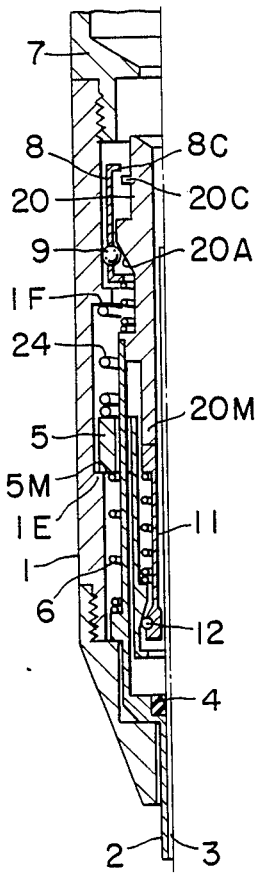
FIG. 8 is a fragmentary axial section through a slight modification of the FIGS. 6 and 7 embodiment.

In a slight modification of the FIGS. 6 and 7 embodiment shown in FIG. 8, the flange portion 5M of the socket 5 is capable of axial displacement between a pair of opposed inside shoulders 1E and 1F of the body 1. There is additionally employed in this mechanical pencil a helical compression spring 24 mounted between the flange portion 5M of the socket 5 and the shoulder 1F of the body 1. The spring 24 biases the socket 5 forwardly with respect to the body 1 with a force greater than both the force of the return spring 6 and the normal manual pressure to be exerted on the pencil during writing. The FIG. 8 embodiment is identical in the other details of construction with that of FIGS. 6 and 7.

The lead guide 2 of the FIG. 8 device can be returned to the illustrated normal position regardless of the extent to which the lead 3 has been worn. To this end a pressure in excess of the normal writing pressure may be exerted on the tip of the lead guide 2 thereby retracting the same, as well as the socket 5, ball cage 8 and thrust member 20, deeper into the body 1 against the forces of the springs 6 and 24 until, with the ball cage rim 8C held against the front end of the sheath 7, the thrust member ridge 20C travels rearwardly past the ball cage rim 8C. Thereupon the balls 9 will become dislodged from between body 1 and thrust member taper 20A thereby permitting the lead guide 2 and other parts to be sprung back to their FIG. 8 positions. The chuck 11 opens when the lead guide 2 is thus manually forced to return to its normal position, just as when it is automatically returned upon wear of the lead to the prescribed degree.

EMBODIMENT OF FIG. 9

Figure 9:
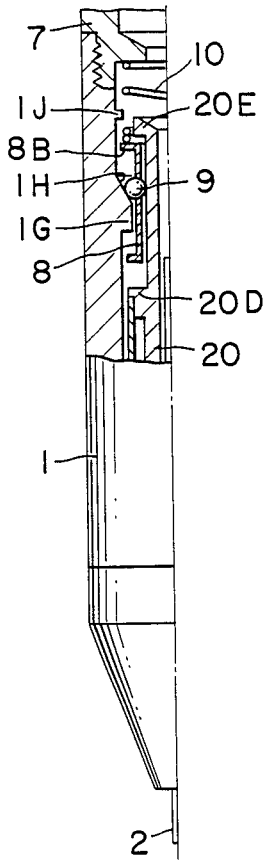
FIG. 9 is a fragmentary axial section, partly in elevation, through a further preferred form of mechanical pencil in accordance with the invention.

A further embodiment of the invention shown in FIG. 9 is also akin to the FIGS. 6 and 7 embodiment in that the one-way locking mechanism is provided between body 1 and thrust member 20. In the present embodiment, however, the body 1 is formed to include an annular inside ridge 1G providing a taper surface 1H decreasing in diameter as it extends toward the writing end of the body, and a smaller annular inside ridge 1J spaced rearwardly from the taper surface 1H. Rotatably carrying the balls 9, the tubular ball cage 8 having a pair of flanges on its opposite ends is concentrically mounted between body 1 and thrust member 20 for axial displacement between a pair of opposed shoulders 20D and 20E of the thrust member. The locking spring 10 extends between the front end of the sheath 7 and the rear end flange 8B of the ball cage 8, normally biasing the balls 9 into engagement between the taper surface 1H of the body 1 and the outer surface of the thrust member 20.

The provision of the locking spring 10 is not essential. Alternatively, the ball cage 8 may be held in frictional contact with the body 1 as via a lining of elastic material secured to the inside surface of the body.

Normally, the ball cage flange 8B lies forwardly of the body ridge 1J. With the axial displacement of the thrust member 20 relative to the body 1, the ball cage flange 8B will positively engage the body ridge 1J in opposition to the force of the locking spring 10 but will disengage the same when the thrust member 20 is thrusted forwardly under the force of the return spring 6, not shown in FIG. 9. The other details of construction can be similar to those of the FIGS. 6 and 7 embodiment. The operation of this FIG. 9 mechanical pencil is also believed to be self-evident from the foregoing operational description of the FIGS. 6 and 7 embodiment.

EMBODIMENT OF FIG. 10

Figure 10:
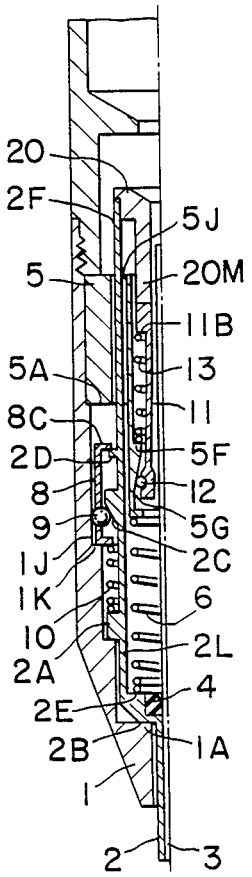
FIG. 10 is a fragmentary axial section through a further preferred form of mechanical pencil in accordance with the invention.

A further preferred embodiment of FIG. 10 is analogous with that of FIGS. 1*a*–3 but differs therefrom in that the one-way locking mechanism is provided between the body 1 and the sleeve 2L integral with the lead guide 2. Thus the sleeve 2L is formed to include an external annular taper surface 2C, decreasing in diameter as it extends toward the writing end of the body 1, and an external annular ridge 2D spaced rearwardly from the taper surface. In the shape of a tube having a pair of inturned rims at its opposite ends, the ball cage 8 is concentrically mounted between body 1 and sleeve 2L for axial displacement between the inside shoulder 1K of the body 1 and the front end 5A of the flange portion of the socket 5. The locking spring 10 acts between the collar 2A of the sleeve 2L and the front end rim of the ball cage 8, normally biasing the balls 9 into engagement between the taper surface 2C of the sleeve 2L and the inside surface 1J of the body 1. The return spring 6 extends between the inside surface 2E of the lead guide shoulder 2B and the front end of the socket 5 for urging the lead guide 2 forwardly with respect to the body 1. The other details of construction can be as set forth in connection with the FIGS. 1*a*–3 embodiment.

In this FIG. 10 embodiment, too, the rear end rim 8C of the ball cage 8 can positively engage the sleeve rim 2C in opposition to the force of the locking spring 10 but will disengage the sleeve rim when the lead guide 2 is forced forwardly by the return spring 6. It is therefore apparent that the one-way locking mechanism of this embodiment operates as in all the previously disclosed embodiments. It will also be appreciated that the thrust member 20 holds the chuck 11 open when the lead guide 2 is in the illustrated normal position.

EMBODIMENT OF FIG. 11

Figure 11:
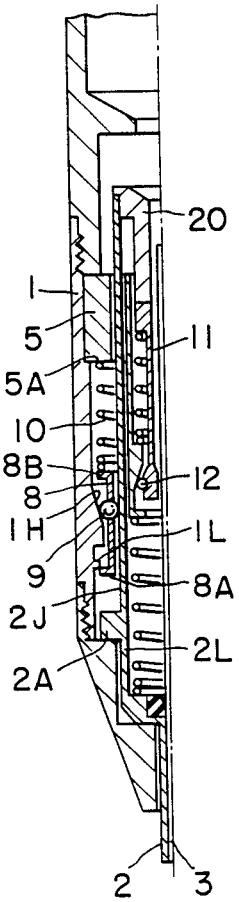
FIG. 11 is a fragmentary axial section through a slight modification of the FIG. 10 embodiment.

A further preferred embodiment of FIG. 11 is equivalent to that of FIG. 10 in that the one-way locking mechanism is provided between body 1 and sleeve 2L. However, in this FIG. 11 embodiment, the body 1 has an annular taper surface 1H and annular ridge 1L formed on its inside surface. The taper surface 1H decreases in diameter as it extends toward the writing end of the body 1, and the ridge 1L is spaced forwardly from the taper surface 1H for selective engagement with the front end flange 8A of the ball cage 8. The locking spring 10 extends between the rear end flange 8B of the ball cage 8 and the shoulder 5A of the socket 5, normally holding the balls 9 in engagement between the outside surface 2J of the sleeve 2L and the taper surface 1H of the body 1. The other details of construction are identical with those of the FIG. 10 embodiment, and the method of operation is belived to be apparent from the foregoing description.

EMBODIMENT OF FIGS. 12 AND 13

Figure 12:
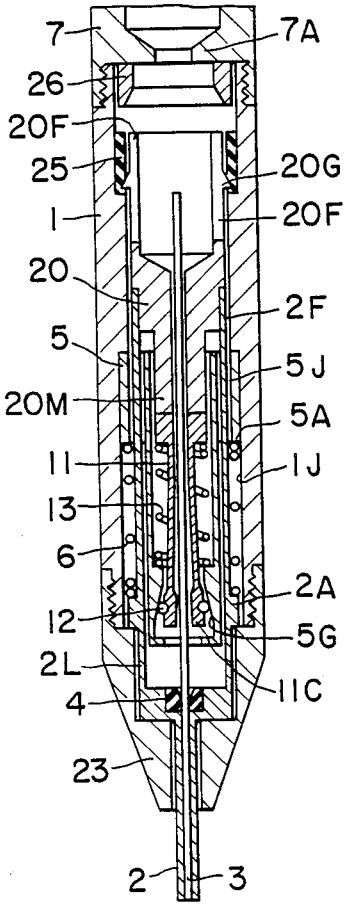
FIG. 12 is a fragmentary axial section through a further preferred form of mechanical pencil in accordance with the invention, with the lead guide shown in the preassigned normal position.
Figure 13:
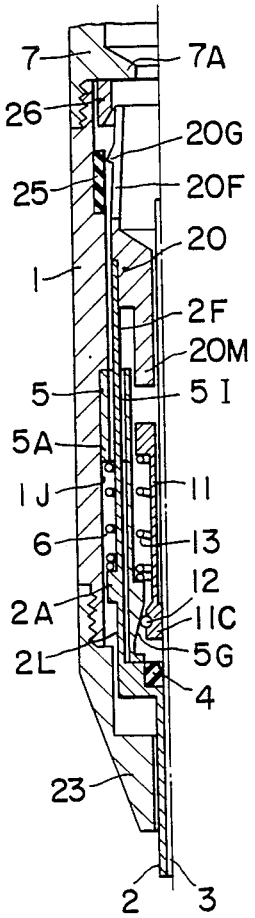
FIG. 13 is a view similar to FIG. 12 except that the lead guide is shown fully retracted.

In a further preferred embodiment of the invention shown in FIGS. 12 and 13, a different type of one-way locking mechanism is provided between body 1 and thrust member 20. The thrust member 20 is formed to include a rearward extension 20F of tubular shape having a plurality of parallel slits extending forwardly from its rear end. These slits are intended to permit at least the rear end portion of the thrust member extension 20F to be resiliently constricted as shown in FIG. 13. Formed on the outside surface of the thrust member extension 20F is an annular ridge 20G which tapers toward the rear end of the thrust member extension and which forms a part of the one-way locking mechanism of this embodiment.

The one-way locking mechanism further includes a tubular lining 25 of rubber or like elastic material immovably attached to the inside surface of the body 1 and concentrically surrounding at least part of the thrust member extension 20F. Normally, as illustrated in FIG. 12, the taper ridge 20G on the thrust member extension 20F is frictionally held against, or at least partly buried in, the elastic lining 25. Therefore, by reason of the tapering shape of the ridge 20G, the thrust member 20 is normally firmly locked against forward displacement with respect to the elastic lining 25 but is relatively free to travel rearwardly in sliding contact therewith.

An unlocking member 26 is disposed rearwardly of the elastic lining 25 for axial displacement between the rear end of the elastic lining and the inturned rim 7A of the sheath 7. Generally in the shape of a short tube or ring, the unlocking member 26 has an internal taper 26A which decreases in diameter toward the rear end of the unlocking member.

The FIGS. 12 and 13 mechanical pencil is substantially identical in the other details of construction with that of FIGS. 1*a*–3. It will be observed from comparison of FIGS. 1*a* and 12 that the one-way locking mechanism of the FIGS. 12 and 13 embodiment has no spring equivalent to the locking spring 10.

In operation the chuck 11 is open when the lead guide 2 is in the normal position of FIG. 12 but will be closed as the pencil is pressed against a desired surface for writing, as in all the foregoing embodiments. The lead guide 2 as well as the sleeve 2L and thrust member 20 will gradually retract from their FIG. 12 toward their FIG. 13 positions against the force of the return spring 6 with the wear of the lead 3. During such retraction of the thrust member 20 the taper ridge 20G on the thrust member extension 20F will travel in sliding contact with the elastic lining 25. When the pencil is moved off the writing surface, the taper ridge 20G will become firmly embedded in the elastic lining 25 thereby preventing the lead guide 2 from being sprung back to the FIG. 12 position.

As illustrated in FIG. 13, the thrust member extension 20F will have its rear end portion become engaged in the internal taper 26A of the unlocking member 26 when the lead 3 is worn to a predetermined degree. Being slitted longitudinally, the thrust member extension 20F will then be reduced in diameter to such an extent as to result in the disengagement of the taper ridge 20G from the elastic lining 25. The thrust member 20 will travel forwardly with the lead guide 2 under the force of the return spring 6 upon subsequent movement of this implement out of contact with the writing surface. The lead 3 will also travel forwardly in frictional engagement with the friction member 4 on the rear end of the lead guide 2.

Toward the end of its forward stroke the thrust member 20 will butt on the chuck 11 and thrust the same forwardly against the force of the chuck spring 13 thereby opening the gripping jaws 11C under their own bias. The unlocking member 26, which has been engaged with the thrust member extension 20F, will butt on the elastic lining 25 when the lead guide 2 returns to the normal position of FIG. 12 position. The thrust member extension 20F will then become disengaged from the unlocking member 26, and its slitted rear end portion will expand under its own bias, with the consequent re-engagement of the taper ridge 20G in the elastic lining 25 as in FIG. 12. The chuck 11 will remain open as long as the lead guide 2 stays in the normal position, assuring the unbroken supply of successive lengths of lead into the lead guide.

EMBODIMENT OF FIG. 14

Figure 14:
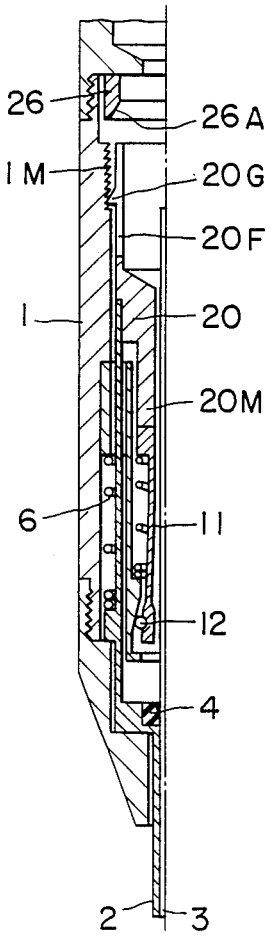
FIG. 14 is a fragmentary axial section through a further preferred form of mechanical pencil in accordance with the invention.

The one-way locking mechanism of FIGS. 12 and 13 is modifiable as shown in FIG. 14, in which the inside surface of the body 1 is knurled to provide a series of small annular ridges or beads 1M in subsitution for the elastic lining 25 of the FIGS. 12 and 13 embodiment. Preferably, and as shown, the annular beads 1M are of saw-toothed axial section, with the front slope of each tooth being less steep than the rear slope. The taper ridge 20G is formed on the slitted rearward extension 20F of the thrust member 20 for engagement with the saw-toothed beads 1M. The other details of construction can be identical with those of the FIGS. 12 and 13 embodiment. It is therefore apparent that despite the modified one-way locking mechanism, the thrust member 20 functions to hold the chuck 11 open when the lead guide is in the normal position.

EMBODIMENT OF FIG. 15

Figure 15:
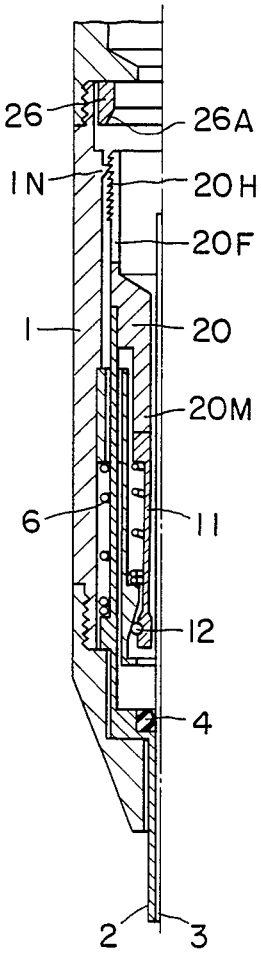
FIG. 15 is a fragmentary axial section through a slight modification of the FIG. 14 embodiment.

FIG. 15 shows another similar modification of the one-way locking mechanism of FIGS. 12 and 13. In this modification the series of saw-toothed annular beads are formed on the slitted rearward extension 20F of the thrust member 20, as indicated at 20H, for engagement with a taper ridge 1N formed on the inside surface of the body 1. The taper ridge 1N tapers rearwardly of the body 1. The other details of construction can be similar to those of the FIGS. 12 and 13 embodiment. This modified one-way locking mechanism does not affect the desired functions of the thrust member 20, either.

EMBODIMENT OF FIGS. 16–18

Figure 16:
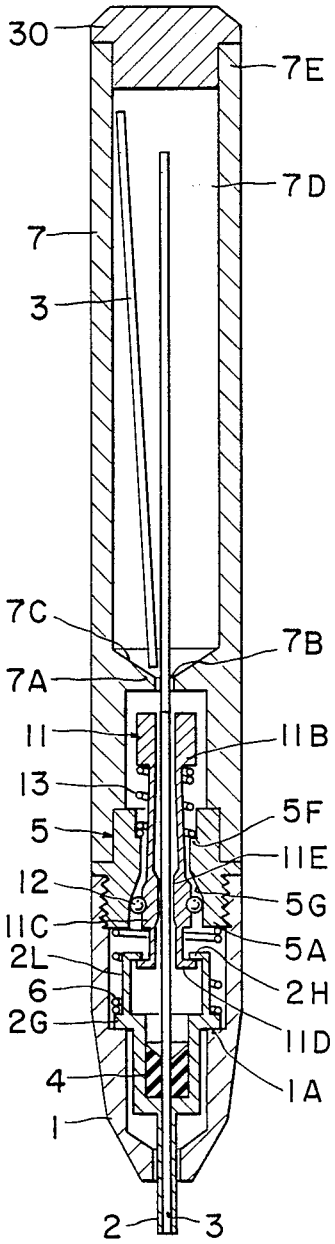
FIG. 16 is an axial section through another type of mechanical pencil embodying the principles of the invention, with the lead guide shown in the preassigned normal position.

With particular reference to FIG. 16 the socket 5 of this embodiment, constituting a part of the chuck means, serves the additional purpose of interconnecting the body 1 and the sheath 7, by being snugly fitted in the front or bottom end of the sheath and screwed into the rear or top end of the body. Thus, essentially, the socket 5 may be thought of as being immovably mounted within the body means comprising the body 1 and sheath 7, as in all the foregoing embodiments. The return spring 6 extends between the front end of the socket 5 and a flange 2G on the front end of the sleeve 2L integral with the lead guide 2, normally holding the lead guide in the FIG. 16 position in which the sleeve flange 2G butts on the internal shoulder 1A of the body 1.

Concentrically disposed within the socket 5 for axial displacement relative to the same, the chuck 11 has forward extensions from their gripping jaws 11C. The chuck extensions terminate in flange sectors, constituting in combination a flange 11D, disposed within the sleeve 2L for positive engagement with an inturned rim 2H on the rear end of the sleeve. The chuck spring 13 acts between the external shoulder 11B of the chuck 11 and the internal shoulder 5F of the socket 5 for biasing the chuck rearwardly with respect to the socket and also for biasing the lead guide 2 rearwardly with respect to the body 1 via the interengaging sleeve rim 2H and chuck flange 11D.

It is to be noted that the force of the chuck spring 13 is less than that of the return spring 6. Normally, therefore, the return spring 6 holds the lead guide 2 in the FIG. 16 position in opposition to the force of the chuck spring 13, with the chuck 11 displaced forwardly of the socket 5. The set of gripping jaws 11C of the chuck 11 are thus open when the lead guide 2 is in the preassigned normal position.

The sheath 7 forming a rearward or upward extension of the body 1 is constructed substantially as in all the foregoing embodiments, defining the lead storage chamber 7D having a funnel-shaped bottom 7C defined by the partition 7A. The rear end of the sheath 7 is closed by a cap 30. This embodiment is akin in the other details of construction to the preceding embodiments except for the absence of the thrust member 20 and the one-way locking mechanism.

Figure 17:
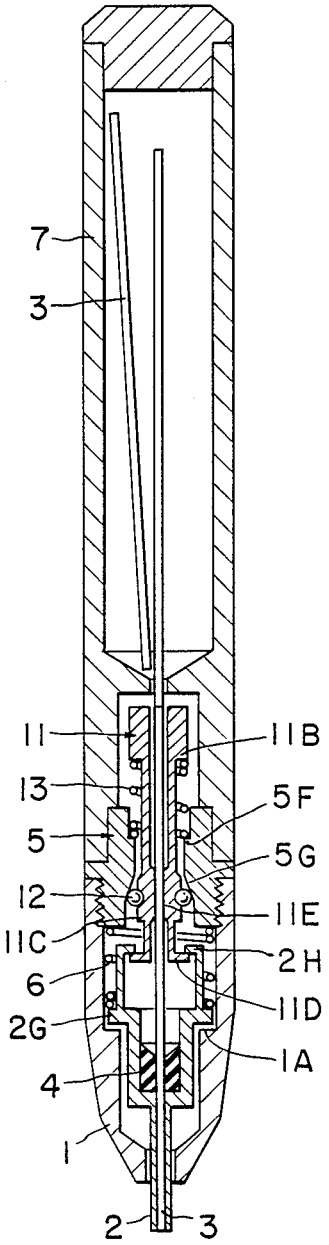
FIG. 17 is a view similar to FIG. 16 except that the lead guide is shown slightly retracted into the body.

In operation, as this mechanical pencil is pressed against a desired surface for writing, the lead guide 2 will retract from its FIG. 16 position to that of FIG. 17 against the force of the return spring 6. Thereupon the chuck 11 will also retract under the bias of the chuck spring 13, with the balls 12 on its gripping jaws 11C traveling over the internal taper 5G of the socket 5, with the consequent closure of the gripping jaws. The lead 3 will be held firmly gripped by the surfaces 11E of the jaws 11C against any further retraction during the subsequent process of writing.

Figure 18:
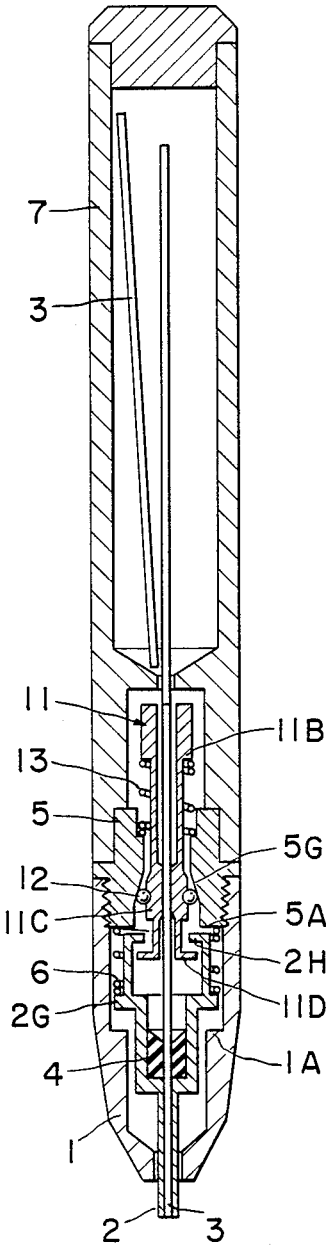
FIG. 18 is also a view similar to FIG. 16 except that the lead guide is shown fully retracted into the body.

With the wear of the lead 3 the lead guide 2 will retreat further into the body 1 against the force of the return spring 6 until the lead guide reaches the FIG. 18 position. Then, as the pencil is moved off the writing surface, the lead 3 will be propelled forwardly with the lead guide 2 under the force of the return spring 6, the lead being engaged by the friction shoe 4 on the rear end of the lead guide. Toward the end of the forward stroke of the lead guide 2, the sleeve rim 2H will reengage the chuck flange 11D and will pull the chuck 11 forwardly against the force of the chuck spring 13, it being understood that the force of this chuck spring is less than that of the return spring 6. Therefore, when the lead guide 2 returns to the normal position of FIG. 16 with the lead 3, the gripping jaws 11C will spread apart under their own bias, as shown in this figure.

It will have been seen, then, that the chuck 11 is held open under the force of the return spring 6 as long as the lead guide 2 is in the normal position, just as in all the foregooing embodiments. If then the lead 3 has been worn short enough, the next length of lead will fall from the storage chamber 7D through the open chuck 11 into end-to-end abutment against the worn lead within the lead guide 3. When this mechanical pencil is subsequently put to writing, the chuck 11 will grip the next length of lead, making it possible to write with the worn lead until the latter is used up.

EMBODIMENT OF FIG. 19

Figure 19:
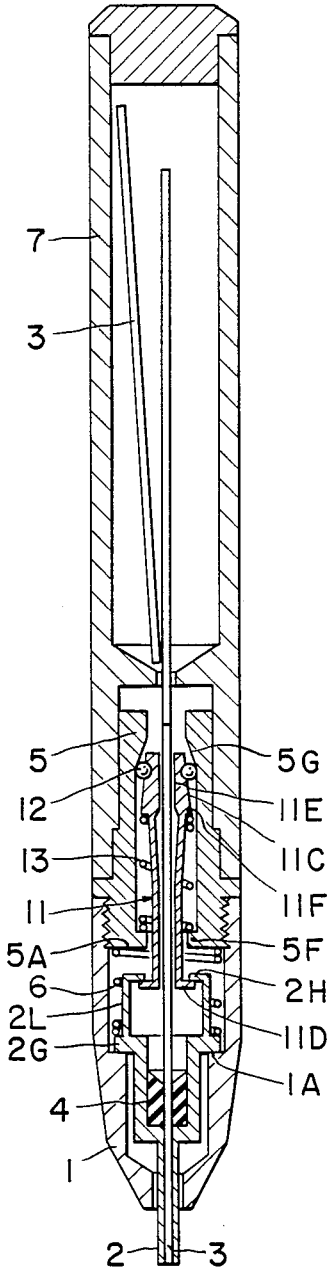
FIG. 19 is an axial section through a slight modification of the FIGS. 16–18 embodiment.

The FIG. 19 mechanical pencil is equivalent to that of FIGS. 16–18 except for the chuck means. The modified chuck means of this embodiment includes the chuck 11 having its gripping jaws 11C directed away from the writing end of the body 1. The gripping jaws 11C are self-biased against the rearwardly tapering surface 5G of the socket 5 via the balls 12. The chuck 11 has the forward extension terminating in the flange 11D for engagement with the rim 2H of the sleeve 2L. The chuck spring 13 extends between the external shoulder 11F of the chuck 11 and the internal shoulder 5F of the socket 5, biasing the chuck rearwardly with respect to the socket with a force less than that of the return spring 6. The other details of construction are as above described in connection with the FIGS. 16–18 embodiment.

When the lead guide 2 is in the preassigned normal position under the bias of the return spring 6 as drawn in FIG. 19, the chuck 11 is displaced forwardly with respect to the socket taper 5G against the force of the chuck spring 13. The gripping jaws 11C are therefore open under their own bias, permitting the free passage of the lead 3 therethrough.

EMBODIMENT OF FIG. 20

Figure 20:
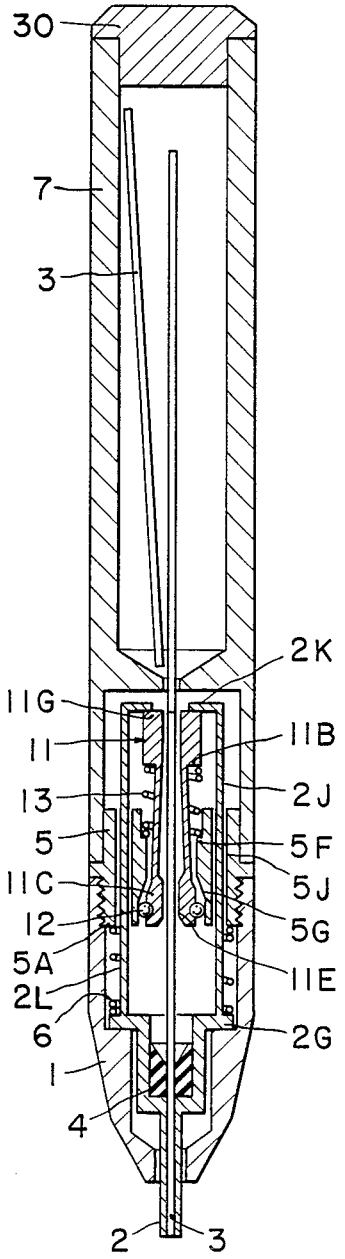
FIG. 20 is an axial section through another slight modification of the FIGS. 16–18 embodiment.

FIG. 20 shows another slight modification of the FIGS. 16–18 embodiment, in which the sleeve 2L integral with the lead guide 2 has at least one, preferably two or more, connective strips 2J extending rearwardly therefrom through clearance holes 5J in the socket 5 and each terminating in a hook 2K. These hooks are movable into and out of engagement with the rear end 11G of the chuck 11 with the axial displacement of the lead guide 2 relative to the body 1. The other details of construction can be as above stated in connection with the FIGS. 16–18 embodiment.

When the lead guide 2 is in the normal position as in FIG. 20, the chuck 11 is engaged by the hooks 2K and thereby displaced forwardly with respect to the socket 5 under the force of the return spring 6 and against the force of the chuck spring 13, to such an extent that the gripping jaws 11C are open under their own bias, permitting the free passage of the successive lengths of lead 3 into the lead guide 2. The hooks 2K are movable out of engagement with the chuck 11 upon retraction of the lead guide 2 into the body 1 for permitting the chuck 11 to be closed under the force of the chuck spring 13.

EMBODIMENT OF FIG. 21

Figure 21:
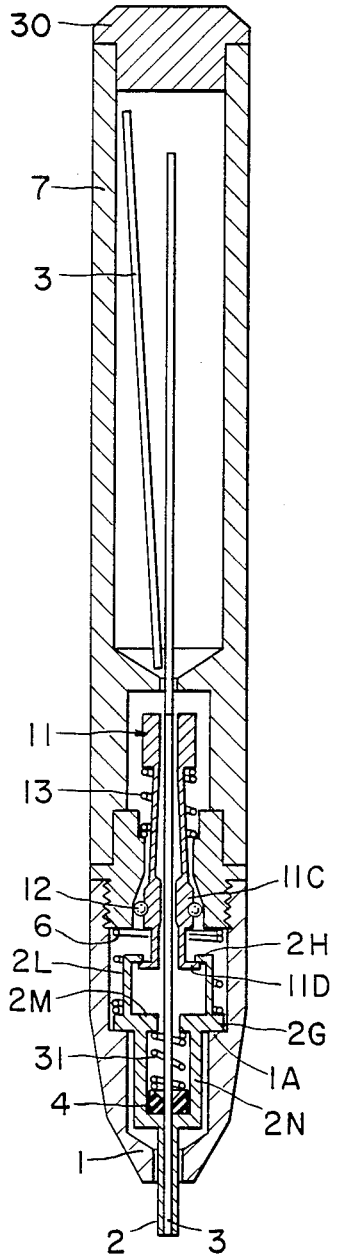
FIG. 21 is an axial section through still another slight modification of the FIGS. 16–18 embodiment.

A further preferred embodiment shown in FIG. 21 is also equivalent to that of FIGS. 16–18 except for an additional helical compression spring 31 mounted within a larger diameter portion 2N through which the lead guide 2 is integrally joined to the sleeve 2L. This additional spring 31, hereinafter referred to as the propelling spring, acts between an annular inside ridge 2M at the rear end of the larger diameter lead guide portion 2N and the friction shoe 4 which is mounted in the larger diameter lead guide portion for axial sliding motion therein. The force of the propelling spring 31 is less than that of the chuck spring 13. Further, when the lead 3 is being engaged by the chuck 11, the movable friction shoe 4 can frictionally retain the lead against axial displacement in opposition to the force of the propelling spring 31. This embodiment is similar in the other details of construction to that of FIGS. 16–18.

In the use of this mechanical pencil, too, the lead guide 2 will retract into the body 1 with the wear of the lead 3. Then, when the pencil is moved off the writing surface, the lead guide 2 will start traveling toward the normal position of FIG. 21 under the force of the return spring 6. As will be seen by referring back to FIG. 18, the chuck 11 will remain closed under the bias of the chuck spring 13 until the sleeve rim 2H move into abutting engagement with the chuck flange 11D. As long as the chuck 11 remains so closed and tightly grips the lead 3, the movable friction shoe 4 will be at a standstill with the lead in opposition to the force of the propelling spring 31, the latter being so weak as aforesaid in comparison with the frictional force of the shoe 4 and the force of the chuck spring 13.

Upon abutting engagement of the sleeve rim 2H with the chuck flange 11D, the chuck 11 will start traveling forwardly with the lead guide 2 against the force of the chuck spring 13, which spring force is less than that of the return spring 6, resulting in the opening of the gripping jaws 11C. Thus released from the chuck 11, the lead 3 will be propelled by the propelling spring 31 acting on the friction shoe 4, until the friction shoe returns to the FIG. 21 position with respect to the larger diameter lead guide portion 2N. The lead guide 2 will also return to the FIG. 21 position with respect to the body 1 under the force of the return spring 6. The chuck 11 is open when the lead guide 2 is in this normal position.

It is to be appreciated in connection with the FIG. 21 embodiment that the lead 3 is propelled with some delay after the lead guide 2 has started traveling back to its normal position. Accordingly, even if the chuck 11 grips the lead very tightly while being closed, there is no possibility of the friction shoe 4 sliding over the lead and so failing to propel the lead durign the return stroke of the lead guide 2.

EMBODIMENT OF FIG. 22

Figure 22:
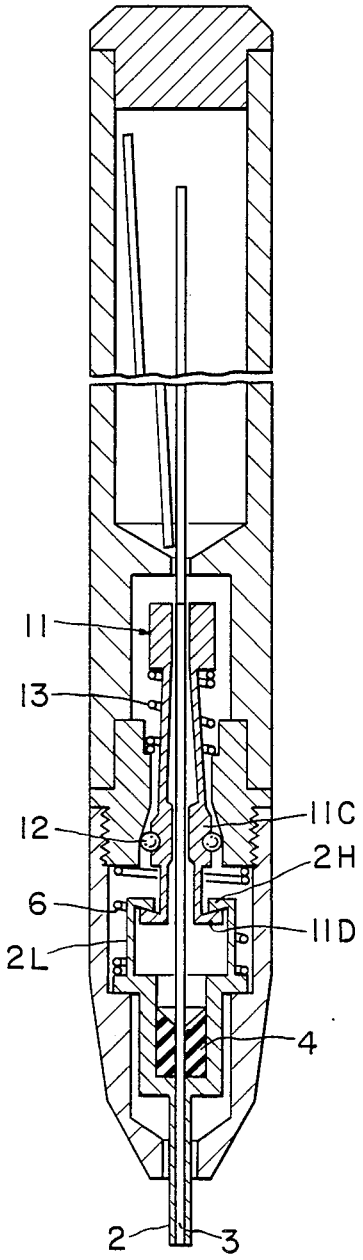
FIG. 22 is an axial section through a further slight modification of the FIGS. 16–18 embodiment.

FIG. 22 illustrates a further slight modification of the FIGS. 16–18 embodiment, which modification is designed to make sure that the chuck will infallibly open when the lead guide is sprung back to the normal position. To this end the front surface of the sleeve rim 2H is inclined toward the writing end of the body 1 as it extends radially inwardly, and the rear surface of the split chuck flange 11D is inclined away from the writing end of the body as it extends radially inwardly. The other details of construction can be as previously set forth in connection with the FIGS. 16–18 embodiment.

Upon abutting contact of these sloping surfaces of the sleeve rim 2H and chuck flange 11D with each other during the return stroke of the lead guide 2, the split chuck flange **11*d* will slide radially outwardly over the sleeve rim 2H thereby spreading apart the gripping jaws 11C. It will therefore be understood that the gripping jaws 11C need not be self-biased radially outwardly, as they are forced open upon engagement of the sleeve rim 2H and chuck flange 11D. The force of the chuck spring 13 can also be correspondingly reduced for closing such unbiased gripping jaws 11C**.

EMBODIMENT OF FIG. 23

Figure 23:
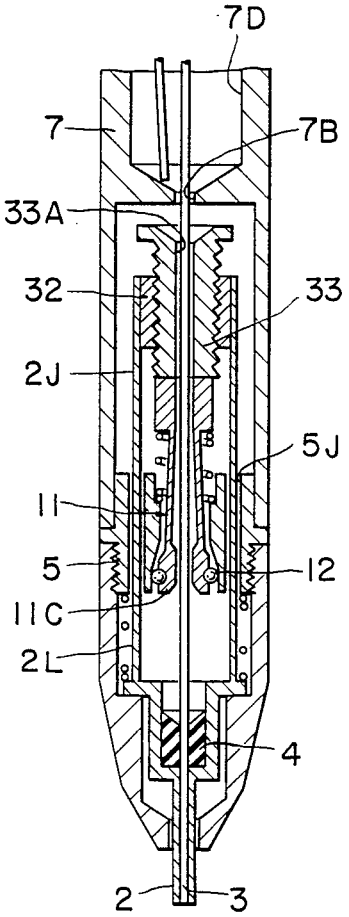
FIG. 23 is a fragmentary axial section through a still further slight modification of the FIGS. 16–18 embodiment.

In FIG. 23 is shown a further modification of the FIGS. 16–18 embodiment, which modification is similar to FIG. 20 but which is capable of fine adjustment of the extend to which the chuck 11 is opened when the lead guide 2 is in the normal position. As in the FIG. 20 embodiment the sleeve 2L has connective strips 2J extending rearwardly therefrom through clearance holes 5J in the socket 5. The connective strips 2J rigidly carry on their rear ends an internally threaded member 32 in coaxial relation to the sheath 7. Mated with the internally threaded member 32 is an externally threaded member 33 having defined therethrough a lead passageway 33A in axial alignment with the hole 7B in the bottom of the lead storage chamber 7D and with the axial lead passageway in the chuck 11. The externally threaded member 33, lying rearwardly of the chuck 11, is movable into and out of end-to-end abutment against the chuck. This embodiment is identical in the other details of construction with that of FIG. 20.

During the assemblage of this mechanical pencil, the externally threaded member 33 may be manually turned in either direction with respect to the internally threaded member 32 for fine adjustment of the extent to which the gripping jaws 11C are to spread apart under their own bias when the lead guide is in the preassigned normal position. With this fine adjustment completed, the complete assembly of the threaded members 32 and 33, lead guide 2, chuck means, etc., may be mounted within the body means.

EMBODIMENT OF FIGS. 24 AND 25

Figure 24:
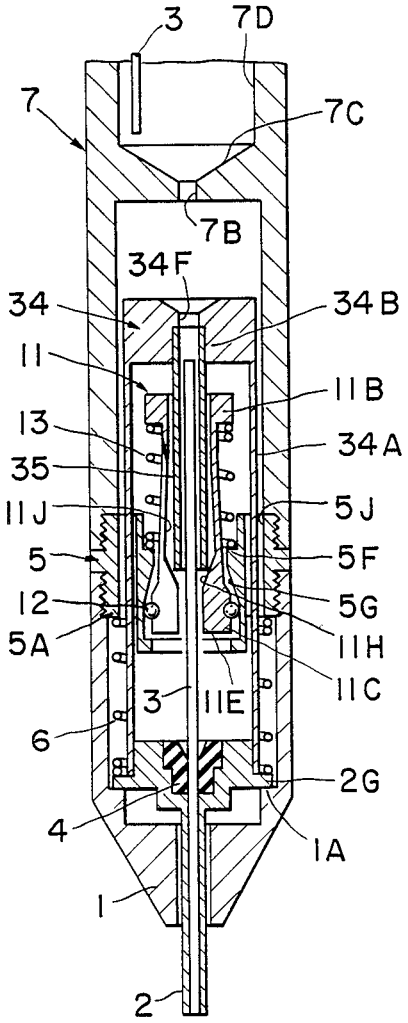
FIG. 24 is a fragmentary axial section through a further different type of mechanical pencil embodying the principles of the invention, with the lead guide shown in the preassigned normal position.
Figure 25:
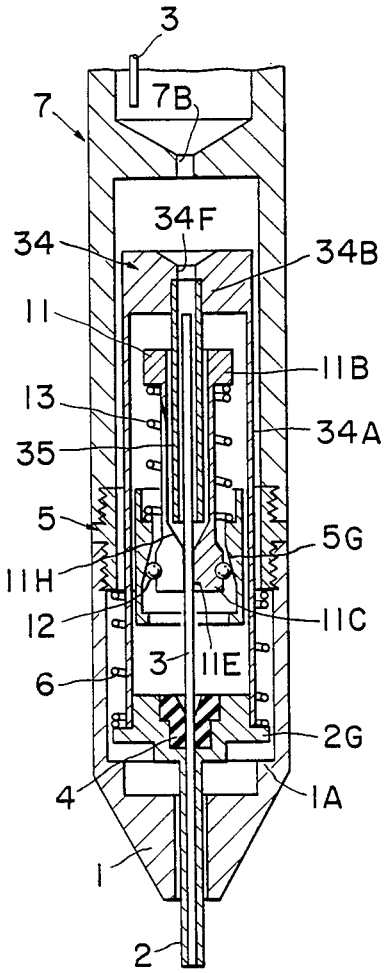
FIG. 25 is a view similar to FIG. 24 except that the lead guide is shown slightly retracted into the body.

A further preferred form of mechanical pencil shown in FIGS. 24 and 25 employs a chuck opener 34 for holding the chuck 11 open when the lead guide 2 is in the preassigned normal position of FIG. 24, in which the flange 2G of the lead guide butts on the internal shoulder 1A of the body 1 under the bias of the return spring 6. The chuck opener 34 has a cylindrical support portion 34B coaxially received in the sheath 7 with clearance and disposed rearwardly of the chuck 11. The chuck opener support portion 34B rigidly supports a tubular plunger 35 extending forwardly therefrom into the axial hollow 11J of the chuck 11 for axial displacement relative to the same. Formed in one piece with the chuck opener support portion 34B, two or more connective strips 34A also extend forwardly therefrom through the clearance holes 5J in the socket 5 and are coupled to the lead guide flange 2G, so that the chuck opener 34 is movable axially of the body means 1 and 7 with the lead guide 2. The chuck opener support portion 34B has a funnel-shaped lead passageway 34F defined axially therethrough in alignment with the hole 7B in the bottom of the lead storage chamber 7D and the axial bore of the plunger 35.

When the lead guide 2 is in the normal position as shown in FIG. 24, the plunger 35 is fully received in the hollow 11J of the chuck 11, with its front end abutting against an annular internal taper 11H of the chuck. Disposed just rearwardly of the gripping heads 11C, the internal taper 11H decreases in diameter as it extends forwardly. Therefore, when the plunger 35 is fully received in the chuck 11 into abutting engagement with its internal taper 11H, the gripping jaws 11C will be forcibly spread apart to admit the free passage of the lead 3 therethrough. Thus forced open, instead of opening under their own bias as in most of the foregoing embodiments, the gripping jaws 11C will provide a lead passageway in exact alignment with the axial bore of the plunger 35 thereby assuring the uninterrupted delivery of successive lengths of lead into the lead guide 2.

It will therefore be appreciated that the gripping jaws 11C of this embodiment need not be self-biased in a radially outward direction. The chuck spring 13 can be less strong for firmly closing the chuck 11 than if the gripping jaws are self-biased radially outwardly. Furthermore, the use of the tubular plunger 35 telescopically nested in the chuck 11 assures the positive opening of the gripping jaws 11C and the smooth delivery of the successive lengths of lead into the lead guide 2.

As illustrated in FIG. 25, the gripping jaws 11C will firmly grip the lead 3 under the force of the chuck spring 13 as the pencil is pressed against a desired surface for writing, because then the plunger 35 will retract with the lead guide 2 out of engagement with the internal taper 11H of the chuck 11. The lead guide 2 as well as the other parts coupled thereto will retract further into the body 1 against the force of the return spring 6 with the wear of the lead 3. Whenever the pencil is moved off the writing surface, the lead guide 2 will be sprung back to the FIG. 24 position, resulting in the opening of the chuck 11 by the plunger 35.

EMBODIMENT OF FIGS. 26 AND 27

Figure 26:
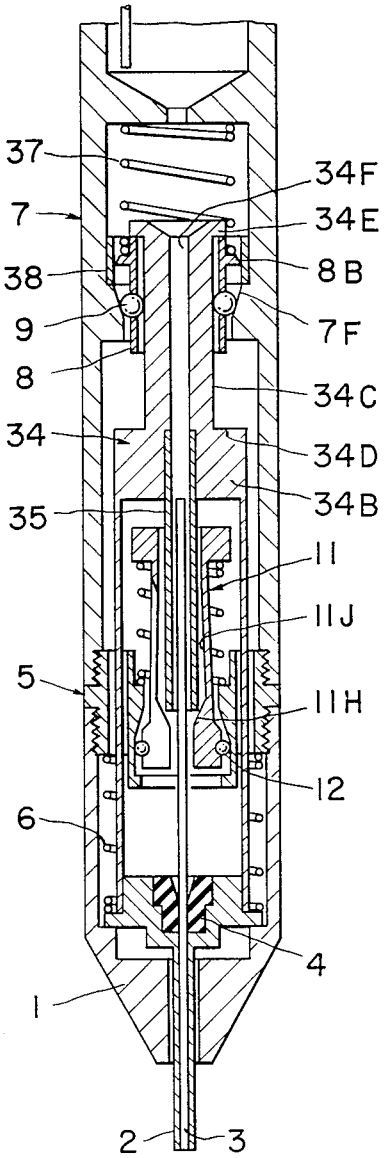
FIG. 26 is a fragmentary axial section through a slight modification of the FIGS. 24 and 25 embodiment, with the lead guide is shown in the preassigned normal position.
Figure 27:
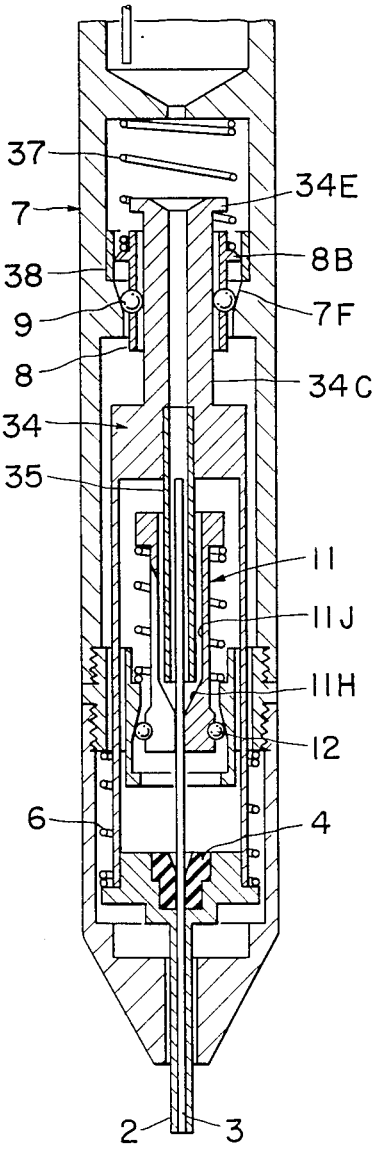
FIG. 27 is a view similar to FIG. 26 except that the lead guide is shown slightly retracted into the body.

In FIGS. 26 and 27 the mechanical pencil of FIGS. 24 and 25 is shown adapted to incorporate a one-way locking mechanism. The one-way locking mechanism comprises a rearward extension 34C of cylindrical shape from the chuck opener support portion 34B, with the funnel-shaped lead passageway 34F defined not only through the chuck opener support portion 34B but also through the chuck opener extension 34C. The chuck opener extension 34C is disposed coaxially and with clearance within the sheath 7. Concentrically surrounding the chuck opener extension 34C is an annular internal taper surface 7F formed on the sheath 7 so as to decrease in diameter as it extends forwardly.

The one-way locking mechanism further comprises the tubular ball cage 8 coaxially interposed between sheath 7 and chuck opener extension 34C and rotatably carrying the balls 9. The ball cage 8 is formed in one piece with an annular taper ridge 8B, decreasing in diameter toward the rear end of the ball cage, for frictional engagement with a tubular lining 38 of rubber or like elastic material immovably fitted in the sheath 7. A chuck spring 37 biases the ball cage 8 forwardly with respect to the body 1, with a force that is so weak that the taper ridge 8B in frictional contact with the elastic lining 38 can retain the balls 9 out of engagement between taper surface 7F and chuck opener extension 34C in opposition to the force of the chuck spring 37. The other details of construction are as above described in conjunction with the FIGS. 24 and 25 embodiment.

The one-way locking mechanism operates as in some of the foregoing embodiments to permit the lead guide 2 to retract with the wear of the lead 3 but to prevent the lead guide from being sprung back to the normal position, as shown in FIG. 27, until the lead becomes worn to a predetermined degree. Upon wear of the lead 3 to the predetermined degree the shoulder 34D of the chuck opener 34 will come to push the ball cage 8 rearwardly against the force of the locking spring 37 thereby dislodging the balls 9 from between taper surface 7F and chuck opener extension 34C.

So pushed rearwardly, the ball cage 8 will be held in the retracted position since the taper ridge 8B thereon frictionally engages the elastic lining 38 with a force greater than that of the locking spring 37. Therefore, when the pencil is subsequently moved off the writing surface, the lead guide 2 will return to the normal position of FIG. 26 under the force of the return spring 6, with the ball cage 8 held retained in the retracted position. The plunger 35 will open the chuck 11 when the lead guide 2 returns to the normal position. Also, toward the end of the return stroke of the lead guide 2, the flange 34E on the rear end of the chuck opener extension 34C will thrust the ball cage 8 forwardly, resulting in the reengagement of the balls 9 between taper surface 7F and chuck opener extension 34C.

EMBODIMENT OF FIG. 28

Figure 28:
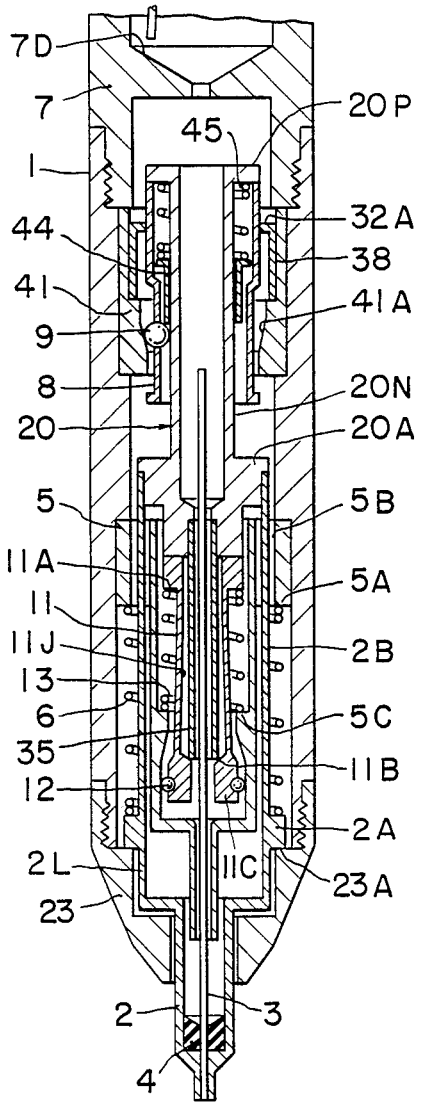
FIG. 28 is a fragmentary axial section through a further preferred form of mechanical pencil in accordance with the invention.

FIG. 28 shows a still further preferred embodiment that employs a different type of one-way locking mechanism in combination with the chuck opening means used in the FIGS. 24–27 embodiments. The lead guide 2 having the friction member 4 and formed integral with the sleeve 2L is concentrically mounted in the body 1, complete with the mouthpiece 23, for axial displacement relative to the same. The lead guide 2 is biased forwardly of the body 1 by the return spring 6 acting between the shoulder 5A of the socket 5 and the collar 2A on the sleeve 2L, with the result that the collar 2A is held against the inside shoulder 23A of the mouthpiece 23 when the lead guide 2 is in the normal position as depicted. The sleeve 2L is rigidly coupled to a chuck opener 20 via connective strips 2B loosely extending through holes 5B in the socket 5.

Coaxially disposed within the taper socket 5 is the chuck 11 having the gripping jaws 11C with the balls 9 rotatably mounted thereon for rolling engagement with the internal taper of the socket 5. The chuck spring 13 acts between the internal shoulder 5C of the socket 5 and the shoulder 11A of the chuck 11, biasing the balls 9 into engagement with the internal taper of the socket. Normally, however, the tubular plunger 35 extending forwardly from the support portion of the chuck opener 20 acts on the gripping jaws 11C at 11B thereby opening the jaws in accordance with a feature of the invention.

The one-way locking mechanism of this embodiment includes a tubular rearward extension 20N of the chuck opener 20 disposed coaxially and with clearance within the body 1. A taper member 41 in the form of a short tube or ring having an internal taper surface 41A is immovably mounted within the body 1 so as to concentrically surround the chuck opener extension 20N. The taper surface 41A decreases in diameter as it extends forwardly of the body 1. Rotatably carrying the balls 9, the tubular ball cage 8 is concentrically disposed between chuck opener extension 20N and taper member 41. The ball cage 8 is displaceable axially relative to the chuck opener extension 20N between the shoulder 20A on its front end and a flange 20P on its rear end.

Additionally incorporated in the one-way locking mechanism of this embodiment is a ball cage retarder 38 herein shown as a short tube of rubber or like elastic material. The ball cage retarder 38 is mounted fast to the inside surface of the taper member 41 and has an inturned rim 32A for frictional engagement with a rear end portion of the ball cage 8.

Preferably, and as shown, a ball pusher 44 in the form of a flanged tube is loosely fitted over the chuck opener extension 20N and is disposed rearwardly of the balls 9. A locking spring 45 extends between the ball pusher 44 and the rear end flange 20P of the chuck opener extension 20N, biasing the balls 9 forwardly via the ball pusher. Normally, therefore, the balls 9 are caught between the chuck opener extension 20N and the taper surface 41A of the member 41 under the bias of the locking spring 45. Both ball pusher 44 and locking spring 45 are, however, not essential parts of this one-way locking mechanism.

The noted ball cage retarder 38 can frictionally retain the ball cage 8 against axial displacement in opposition to the forward force of the locking spring 45 but will yield to permit the ball cage to slide forwardly therepast when the force of the return spring 6 acts on the ball cage via the rear end flange 20P of the chuck opener extension 20N.

Despite the showing of FIG. 28, the ball cage retarder 38 need not be secured to the taper member 41. Alternatively, the ball cage retarder could be affixed to the ball cage 8 for frictional engagement with the taper member or with the body 1.

When the mechanical pencil of FIG. 28, with its various working parts in the depicted state, is first pressed against a desired writing surface, the lead guide 2 will slightly retract into the body 1 against the force of the return spring 6. With such retraction of the lead guide 2 the plunger 35 will disengage the gripping jaws 11C thereby permitting the chuck 11 to be displaced rearwardly under the force of the chuck spring 13. Thus the gripping jaws 11C will close for firmly gripping the lead 3 against rearward displacement as the balls 12 roll over the internal taper of the socket 5. The pencil is to be used for writing with its working parts in this state.

The lead guide 2 as well as the chuck opener 20 and its rearward extension 20N will retract against the force of the return spring 6 with the wear of the lead 3 as a result of writing. When the lead 3 is worn to a predetermined degree, the shoulder 20A of the chuck opener 20 will come to butt on the front end of the ball cage 8 whereupon the balls 9 will become dislodged from between the chuck opener extension 20N and the internal taper 41A of the taper member 41 against the frictional force of the ball cage retarder 38 acting on the ball cage 8. The forward bias of the locking spring 45 is also acting on the balls 9 via the ball pusher 44. However, so weak is the force of the locking spring 45 that the balls 9 can be held dislodged by the ball cage retarder 38 in frictional engagement with the ball cage 8. Thus, when the pencil is subsequently moved off the writing surface, the lead guide 2 will travel back to the normal position of FIG. 28 under the bias of the return spring 6 together with the lead 3 in frictional engagement with the friction shoe 4.

Immediately before the lead guide 2 returns to the FIG. 28 position, the rear end flange 20P of the chuck opener extension 20N will come into abutment against the rear end of the ball cage 8 and will thrust the ball cage forwardly against the frictional force of the ball cage retarder 38. Thus the balls 9 will become re-captured between chuck opener extension 20N and taper surface 41A approximately concurrently with the return of the lead guide 2 to the FIG. 28 position.

The gripping jaws 11C will be opened by the plunger 35 when the lead guide 2 returns to the FIG. 28 position. If then the lead 3 in use has been so worn that its rear end is located forwardly of the gripping jaws 11C, another length of lead will fall under its own weight from the lead storage chamber 7D into and through the open chuck 11 into end-to-end abutment against the worn lead. This new lead will be automatically used for writing when the old lead is used up.

Various modifications of the above disclosed embodiments may be resorted to without departing from the scope of the invention.

What is claimed is:

1. A mechanical pencil capable of automatically propelling successive lengths of lead, comprising:

(a) substantially tubular body means having a lead storage chamber formed therein for accommodating spare lengths of lead, for use one after another, the body means having a writing end;

(b) a tubular lead guide receiving a length of lead therein and coaxially mounted with the body means so as to partly protrude outwardly thereof from the writing end thereof and engaged by said return spring, the lead guide being resiliently urged to a preassigned normal position with respect to the body means and being retractable relative to the body means from the preassigned normal position in a direction away from the writing end of the body means against the urging force of said return spring with the wear of the lead;

(c) a friction member mounted on the lead guide for engaging the lead so as to normally cause the lead to travel with the lead guide in the axial direction of the body means;

(d) a socket mounted within the body means and having an annular internal taper surface concentric with the body means, the taper surface decreasing in diameter as it extends away from the writing end of the body means;

(e) a chuck disposed intermediate the lead storage chamber and the lead guide and coacting with the socket for releasably gripping the lead, the chuck being displaceable axially of the body means relative to the socket between an open position, closer to the writing end of the body means, for permitting the free passage of the successive lengths of lead therethrough from the lead storage chamber into the lead guide, and a closed position, away from the writing end of the body means, for tightly gripping the lead against axial displacement in a direction away from the writing end of the body means, said chuck being resiliently biased from the open toward the closed position;

(f) chuck opening means disposed within the body means and coupled to the lead guide for joint displacement therewith axially of the body means, the chuck opening means actuating the chuck from the closed to the open position upon displacement of the lead guide from a retracted to the preassigned normal position;

(g) whereby the chuck is held open when the lead guide is in the normal position, permitting a new length of lead to fall therethrough from the lead storage chamber into the lead guide when the lead that has been received in the lead guide wears short;

(h) one-way locking means for permitting the lead guide to retract into the body means with the wear of the lead during writing or marking and for locking the lead guide against displacement toward the writing end of the body means when the mechanical pencil is moved out of contact with a writing or marking surface; and (i) unlocking means for causing the one-way locking means to permit the lead guide, together with the lead being engaged by the friction member, to travel back to the normal position when the lead is worn to a prescribed degree.

2. The mechanical pencil of claim 1 wherein said one-way locking means comprises annular means fixedly mounted in said tubular body means and having a taper surface which is concentric with the body means and increases in diameter as it extends away from the writing end of the body means, a cylindrical rearward extension projecting from the lead guide into the annular means coaxially with the latter, a ball cage disposed between said annular means and said rearward extension to be slidable axially of the body means, ball means held by the ball cage and disposed between, and in contact with, said taper surface and the rearward extension, ball cage retarder means contacting the ball cage for frictionally preventing the ball cage from moving axially of the body means, and locking spring means urging the ball means forwardly against the taper surface.

3. The mechanical pencil of claim 2 wherein said unlocking means comprises abutment means on the lead guide, said abutment means facing rearwardly and provided at such a position that when the lead is worn to said prescribed degree and the lead guide retracts accordingly, the abutment means abuts against the ball cage to thereby thrust the ball means rearwardly away from the taper surface whereby the one-way locking means is unlocked.

4. A mechanical pencil capable of automatically propelling successive lengths of lead, comprising:

(a) substantially tubular body means having a lead storage chamber formed therein for accommodating spare lengths of lead for use one after another, the body means having a writing end;

(b) a return spring within the body means;

(c) a tubular lead guide receiving a length of lead therein and coaxially mounted within the body means so as to partly protrude outwardly thereof from the writing end thereof and engaged by said return spring, the lead guide having a preassigned normal position with respect to the body means and being retractable relative to the body means from the preassigned normal position in a direction away from the writing end of the body means against the force of the return spring with the wear of the lead;

(d) a friction member mounted on the lead guide for engaging the lead so as to normally cause the lead to travel with the lead guide in the axial direction of the body means;

(e) a socket immovably mounted within the body means and having an annular internal taper surface concentric with the body means, the taper surface decreasing in diameter as it extends away from the writing end of the body means;

(f) a chuck disposed intermediate the lead storage chamber and the lead guide and coacting with the socket for releasably gripping the lead, the chuck being displaceable axially of the body means relative to the socket between an open position, closer to the writing end of the body means, for permitting the free passage of the successive lengths of lead therethrough from the lead storage chamber into the lead guide, and a closed position, away from the writing end of the body means, for tightly gripping the lead against axial displacement in a direction away from the writing end of the body means;

(g) a chuck spring biasing the chuck from the open toward the closed position;

(h) chuck opening means disposed within the body means and coupled to the lead guide for joint displacement therewith axially of the body means, the chuck opening means actuating the chuck from the closed to the open position upon displacement of the lead guide from a retracted to the preassigned normal position under the bias of the return spring;

(i) whereby the chuck is held open when the lead guide is in the normal position, permitting a new length of lead to fall therethrough from the lead storage chamber into the lead guide when the lead that has been received in the lead guide wears short;

(j) one-way locking means for permitting the lead guide to retract into the body means with the wear of the lead during writing or marking and for locking the lead guide against displacement toward the writing end of the body means under the bias of the return spring when the mechanical pencil is moved out of contact with a writing or marking surface; and (k) unlocking means for causing the one-way locking means to permit the lead guide, together with the lead being engaged by the friction member (4), to travel back to the normal position under the bias of the return spring when the lead is worn to a prescribed degree.

5. The mechanical pencil of claim 4 wherein the chuck opening means comprises a tubular plunger rigidly joined to the lead guide and coaxially mounted in the body means, said plunger engaging the chuck for moving the same from the closed to the open position upon displacement of the lead guide from the retracted to the normal position, the plunger disengaging the chuck to permit the same to travel from the open to the closed position upon retraction of the lead guide from the normal position.

6. The mechanical pencil of claim 5 wherein the lead guide has a portion extending rearwardly to a position rearward of the chuck, and said tubular plunger is fixed to said portion so as to extend forwardly into the chuck.

* * * * *